US006791503B2

(12) United States Patent
Kocsi

(10) Patent No.: US 6,791,503 B2
(45) Date of Patent: Sep. 14, 2004

(54) RECEPTION ANTENNA SYSTEM

(76) Inventor: Louis Kocsi, 25 Palisade Ave., Garfield, NJ (US) 07026

( * ) Notice: Subject to any disclaimer, the term of this patent is extended or adjusted under 35 U.S.C. 154(b) by 0 days.

(21) Appl. No.: 10/329,954

(22) Filed: Dec. 27, 2002

(65) Prior Publication Data

US 2004/0125043 A1 Jul. 1, 2004

(51) Int. Cl.[7] ..... H01Q 11/12
(52) U.S. Cl. ..... 343/742; 343/834
(58) Field of Search ..... 343/742, 833, 343/834, 741, 867, 866; H04Q 11/12

(56) References Cited

U.S. PATENT DOCUMENTS 3,626,420 A * 12/1971 Kocsi ..... 343/742
4,584,586 A * 4/1986 Kocsi ..... 343/742
4,989,014 A * 1/1991 Kocsi ..... 343/702
6,429,823 B1 * 8/2002 Bains et al. ..... 343/755

* cited by examiner

*Primary Examiner*—Hoanganh Le
(74) *Attorney, Agent, or Firm*—Melvin K. Silverman

(57) ABSTRACT

A reception antenna system for electrical connection to the positive and negative sides of a transmission feedline employed in television and other telecommunications includes a reflector having a conductive surface. The system includes an even group of electrically open-ended radial pairs, having positive and negative ends, of hollow, substantially scalene triangular conductive loops, each loop of each pair being internally symmetric about a radius of the reflector, each pair of the group disposed at an uniform offset from the surface of the reflector, the offset defined by insulative mounting elements. Upon the reflector are elements for electrically connecting one negative end and one of the open-ended loop pairs to an adjacent negative end of another of the loop pairs to thereby define at least two loop pairs, each of which two pairs define a single conductive array which is electrically, but not radiationally, discreet from the reflector. One end of each loop is connected to a corresponding positive or negative side respectively of the transmission feedline. The electromagnetic geometry of the loop pairs of will substantially amplify signals received from the reflector and, further, will receive and amplify signals independently of the reflector.

11 Claims, 8 Drawing Sheets

RECEPTION ANTENNA SYSTEM

BACKGROUND OF THE INVENTION

The present invention relates to a multi-turn loop reception antenna adapted for use in combination with a reflector element. Such reflector elements, also known as parabolic dishes or earth stations, have been long known in the art as a primary means of receiving signals which have been reflected off of satellites placed in geosynchronous orbit about the earth. Since the development of such parabolic antennas, a need in the art has been that of reducing the size and cost of such structures to make their usage more practical for use by the general public. Accordingly, the instant invention may be viewed as a response to this need in the art.

The general approach of the invention herein is that of the combination of certain plural antenna elements with a flat disc-like reflector. More particularly, the inventor herein has improved upon his technology relating to the use of symmetric pairs of hollow, substantially scalene triangular antenna loops as set forth in his U.S. Pat. No. 4,584,586. Further, this invention is an improvement of my invention of U.S. Pat. No. 4,989,014, entitled Reception Antenna System, of the invention.

To the knowledge of the inventor, the only prior art, which has made use of any combination of reflective and non-reflective elements within a single antenna system appears in U.S. Pat. No. 4,095,230 (1978) to Salmond, entitled High Accuracy Board Band Antenna System; and U.S. Pat. No. 4,160,980 (1979) to Murray, entitled Dipole Antenna and Parabolic Reflector. The reference to Salmond employs a substantially flat reflector in combination with secondary antenna components. This reference to Salmond is apparently of utility only in the tracking of targets by a ground-to-air or air-to-air missile, while the patent to Murray is apparently relevant only to UHF reception.

SUMMARY OF THE INVENTION

The invention is directed to a reception antenna system for electrical connection to the positive and negative sides of a transmission feedline of the type employed in television and other telecommunications. The system comprises a reflector having conductive surface defined by respectively orthogonal ear-like portions of one-quarter of a polar segment of a circle. The system includes an even plurality of electrically open-ended radial pairs, having positive and negative ends, of hollow, substantially scalene triangular conductive loops, each loop of each pair being internally symmetric about a radius of said reflector, each pair of said plurality disposed at a uniform offset from the surface of said reflector, said offset comprising insulative mounting means. Upon said reflector are means for electrically connecting one positive end of one of said open-ended loop pairs to an adjacent positive end of another of said loop pairs to thereby define at least two loop pairs, each of which two pairs comprise a single conductive array which is electrically, but not radiationally, discreet from said reflector. One end of each loop pair is connected to a corresponding positive and negative side respectively of the transmission feedline. The electromagnetic geometry of said loop pairs in combination with said conductive surfaces will substantially amplify signals received from said reflector, and further, will receive and amplify signals independently of said reflector.

It is an object of the present invention to provide a plural element reflector reception antenna having improved signal gain, simplicity of manufacture, and cost-effectiveness over the prior art.

It is another object to provide a plural element reception antenna having a reflector that will provide improved area/volume effectiveness over prior art reflector reception antennas.

It is a further object of the invention to provide an antenna that will provide a high gain over a frequency band encompassing all VHF and UHF frequencies.

It is a yet further object to provide an antenna which will retain its original performance and efficiency even after a prolonged exposure to adverse weather.

A still further object of the invention is to provide a plural element antenna comprising a combined multi-loop and reflector antenna having an improved mechanical design that will provide a maximum frontal area for magnetic field induction.

The above and yet other objects and advantages of the present invention will become apparent from the hereinafter-set forth-Brief Description of the Drawings, Specification and Claims appended herewith.

DETAILED DESCRIPTION OF THE INVENTION

Figure 1:
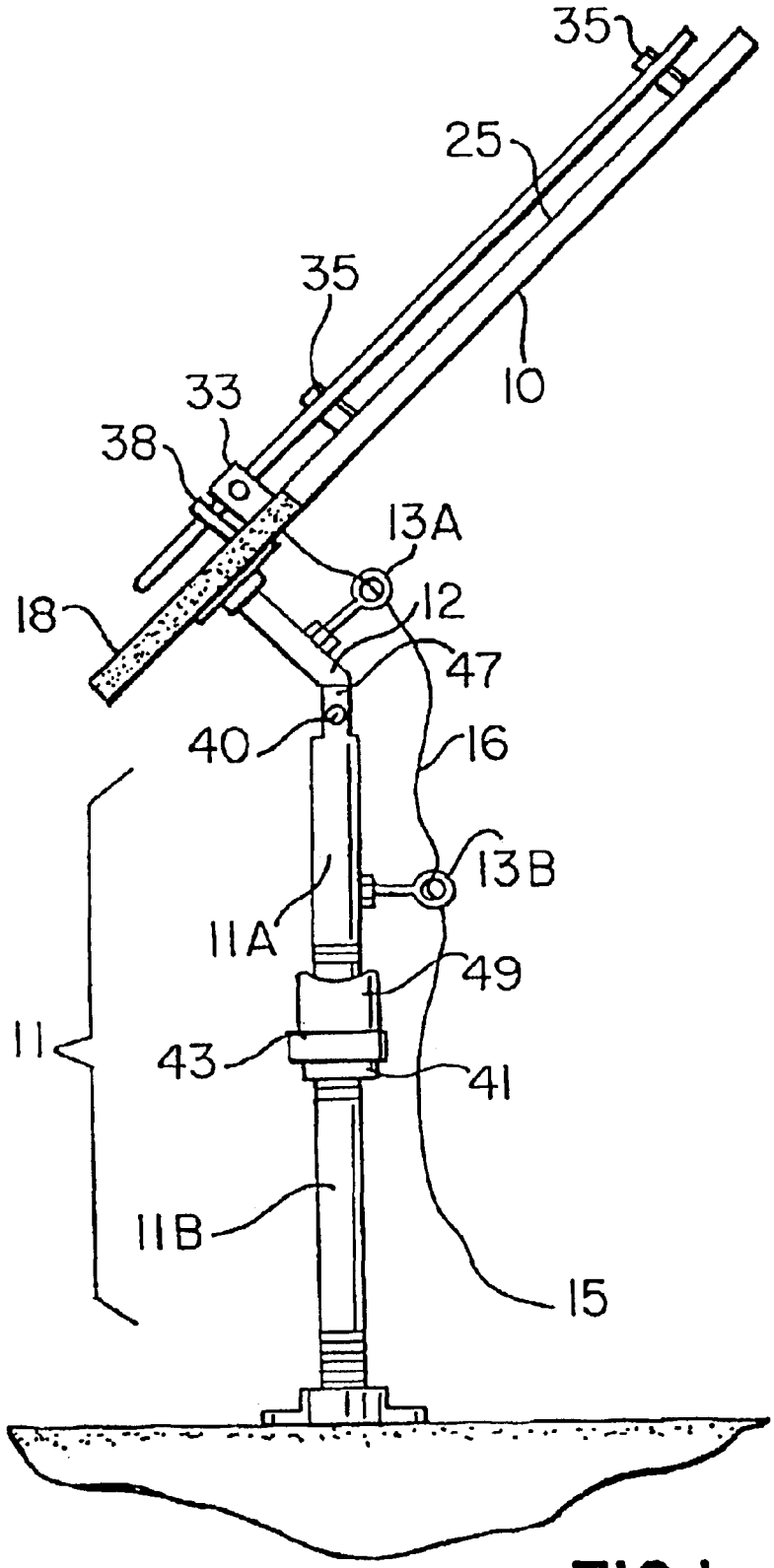
FIG. 1 is a view of the inventive antenna system.

With reference to FIG. 1 there is shown a reception antenna system which includes a reflector 10 having a lower central region 18 which region is rigidly mounted upon an upper post element 12 which, in turn, is rotationally coupled to a post assembly element 11 having an upper member 11A and lower member 11B. Therein, feedline cable 16 passes thru standoff eyelets 13A and 13B, and ultimately comprises reception input 15 to a television.

Figure 5:
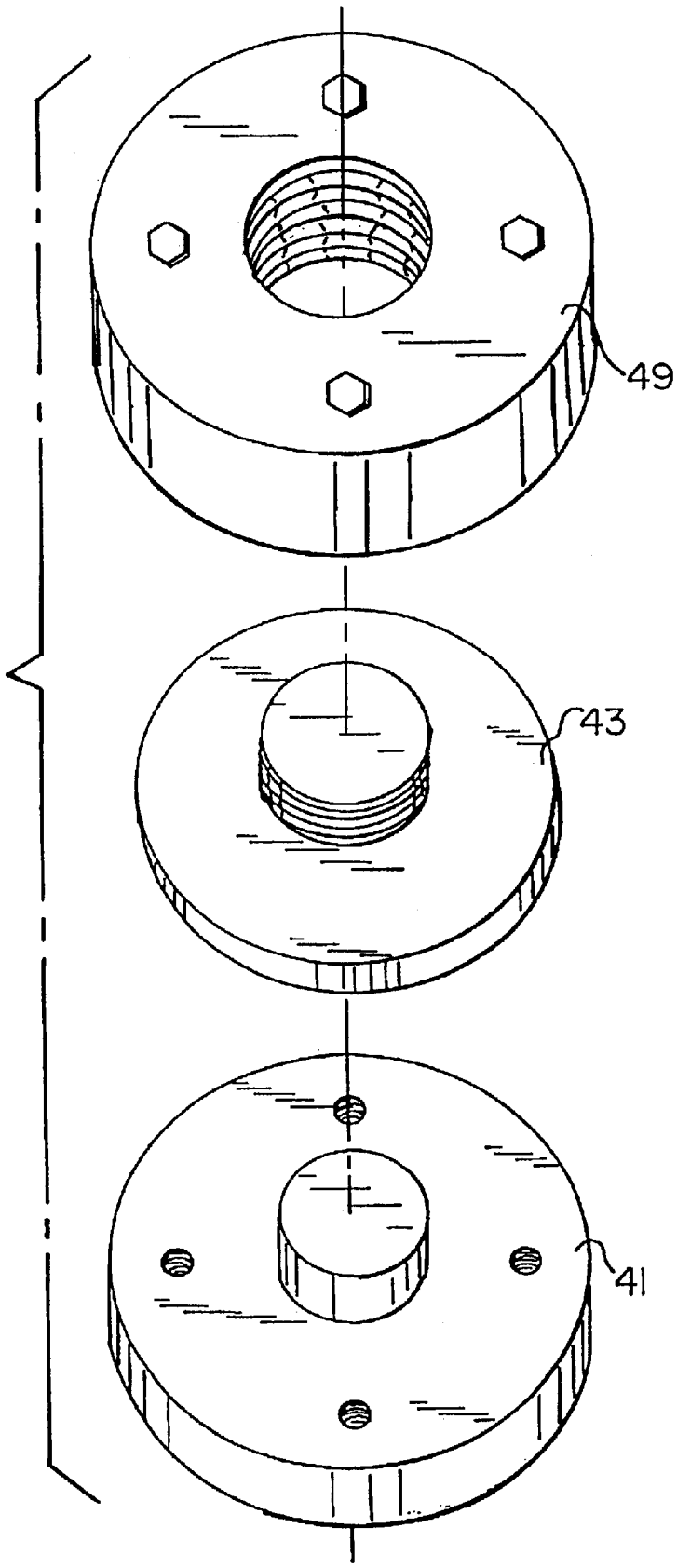
FIG. 5 is an exploded view of the support coupling of the reflector support means.

Included within the present antenna reception system are means for selectively changing the angulation of the axial center line of the reflector relative to a supporting plane of the reflector relative to the plane of a roof or ground to which the reflector may be secured. More particularly, with reference to the view of FIG. 1, and antenna attitude change assembly may be seen to include a screw or bolt 40 the selective tightening and loosing of which will enable upward or change of the angulation of the reflector 10 relative to post assembly 11. Thru the use of elements 41, 43 and 49, shown in FIG. 5, the angular position of member 11A relative to 11B can be changed thereby effecting change of polar position of the reflector.

Figure 2:
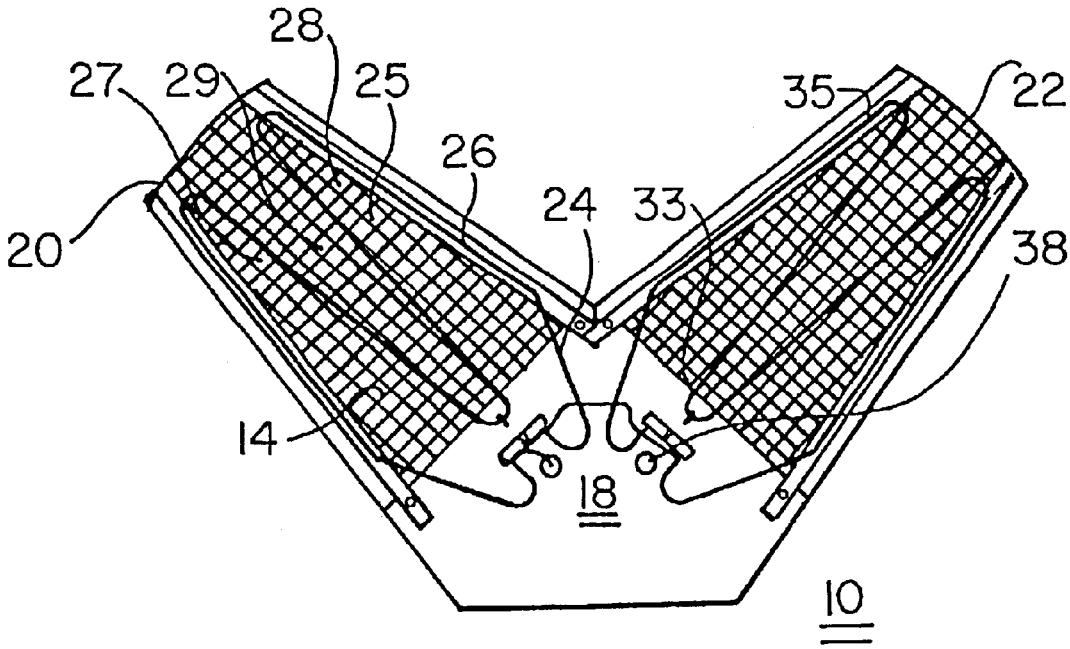
FIG. 2 is a front view of the reflector and center portions of the system.
Figure 3:
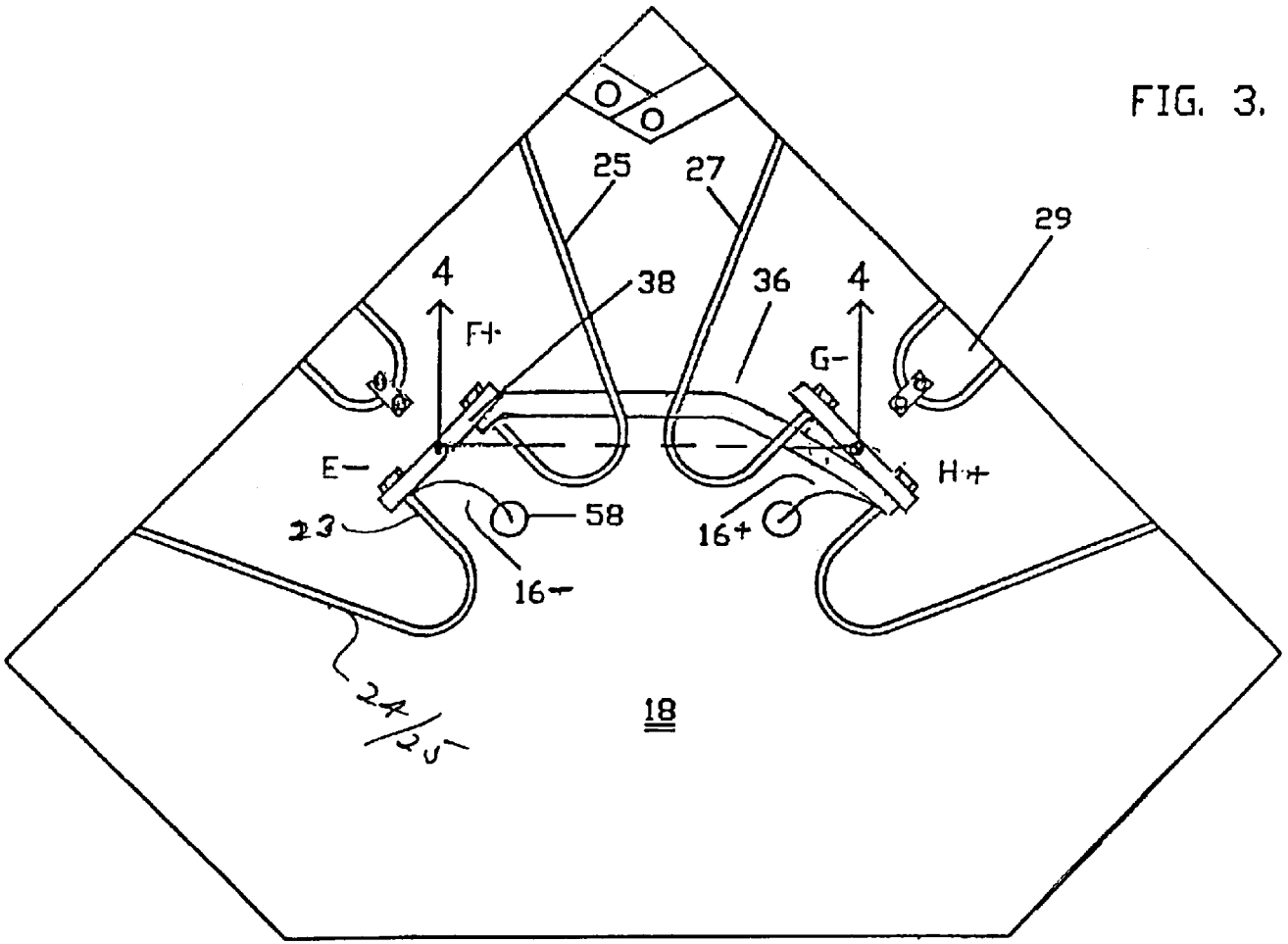
FIG. 3 is an enlarged axial plan view of part of the loop-end conductor assembly shown at the center of FIG. 2.

With respect to the views of FIGS. 2 and 3, it may be seen that positive and negative sides of feedline cable 16 extend through said center region 18 of a reflector 10, passing through holes 58 and, therefrom, into electrical connection with ends 23 of open-ended radial pairs 29 of hollow substantial scalene triangular conductive loops 25 and 27. Also shown is connector 36 which electrically connects the negative end of the conductive loops.

As may be noted in FIG. 2, each loop of each pair is internally symmetric about a radius of said reflector 10. For example, loop 25 of loop pair 29 is symmetric with loop 27 of loop pairs 29. In addition, each loop pair of said plurality of loop pair is disposed up a plane which is substantially parallel with, and at a uniform offset from, the surface of reflector 10 and at center region 18.

This offset is achieved through the user of a plurality of mounting and insulation means 33, 35 and 38 (see FIGS. 1, 2, 3 and 8), each of which are disposed at different radial distances from said axial center line of the reflector, but along an axis of radial symmetry of one loop pair.

It should be appreciated that the surface of reflector 10 and its lower center region 18 is conductive, and define ear-like portions 20 and 22, offset about 90 degrees from each other within one-quarter of a polar segment. In a preferred embodiment, the substrate of the reflector 10 and its center region 18 will be formed of a fiberglass material to which a conductive coating 14 is then applied. Thereupon, may optionally be applied a mesh-like layer of conductive filaments.

With reference to the view of FIG. 3, there is shown, integral with reflector 10, said center region 18 upon which are provided means for electrically connecting, thru cable 16–, one negative end 23 (see head E–) of leg 24 of one of said open ended loop pairs 29 to an adjacent negative end of another end of said loop pairs to thereby define at least two such pairs. See electrical connector 36 in FIGS. 3 and 4. It is to be appreciated that each of said two loop pairs comprises a single conductive array which is electrically, but not radiationally, discreet from said reflector, and that each of said two loop pairs are connected at electrically opposite polarities to positive and negative sides respectively of positive and negative pairs of ($16^+$ and $16^-$) of the transmission feedline cable 16. Consequently, the electromagnetic geometry of said loop pairs 29 in combination with the conductive reflector 10 will amplify signals received from the atmosphere. In addition, it has been found that said loop pairs 29 received and amplify signals, although less efficiently, independently of the conductivity of said reflector.

Figure 7:
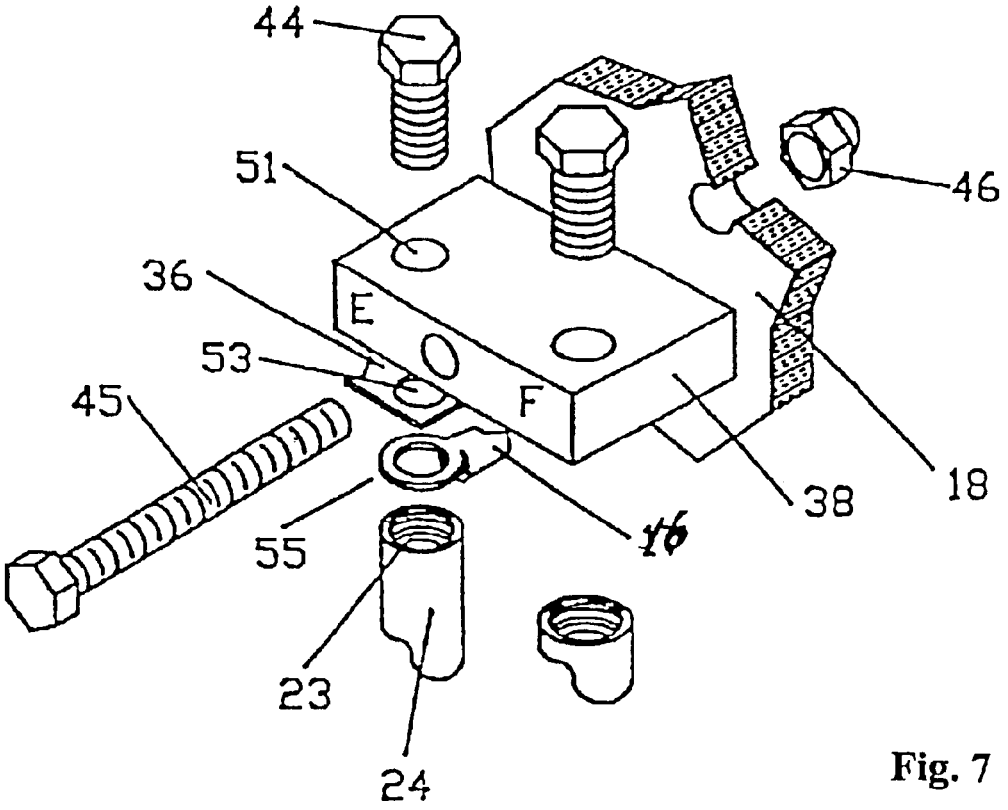
FIG. 7 is an exploded view of the center insulator and its offset means, showing connection to one loop pair.

As may be noted, each loop pair 29 has two open ends 23 (see FIGS. 3 and 7). The polarity of these open ends alternate between positive and negative in the manner shown in FIG. 3. Therein, it may be noted that feedline cable 16– connects to loop ends E and G. As (see FIGS. 2 and 3) successive opposite ends 23 of open ended radial pairs 29 are connected to each other, e.g., connections EF and GH. Thereby, as above noted, the result is that of two conductive surfaces which are electrically, but not radiationally discreet, from the reflector surface.

In certain application, it has been found desirable to use one loop pair for purposes of one form of telecommunication, e.g., television reception, and to use a second loop pair for a different type of telecommunication reception, e.g., cellular telephone reception.

The reflector 10 may comprise a substantially flat surface although, if preferred, a parabolic surface may be employed in the alternative.

A more complete explanation of the electromagnetic operation of the loop pair geometry employed herein is provided in my U.S. Pat. No. 4,584,586.

With further reference to FIG. 2, it is to be appreciated that each triangular loop 25 and 27 is provided with a first small leg 24, an intermediate length leg 26, and a virtual hypotenuse 28. In a preferred embodiment, the length of said legs 24, 26 and 28 will have a ration of one-to-two-to-three, as between the smallest, intermediate and hypotenuse legs thereof.

Figure 4:
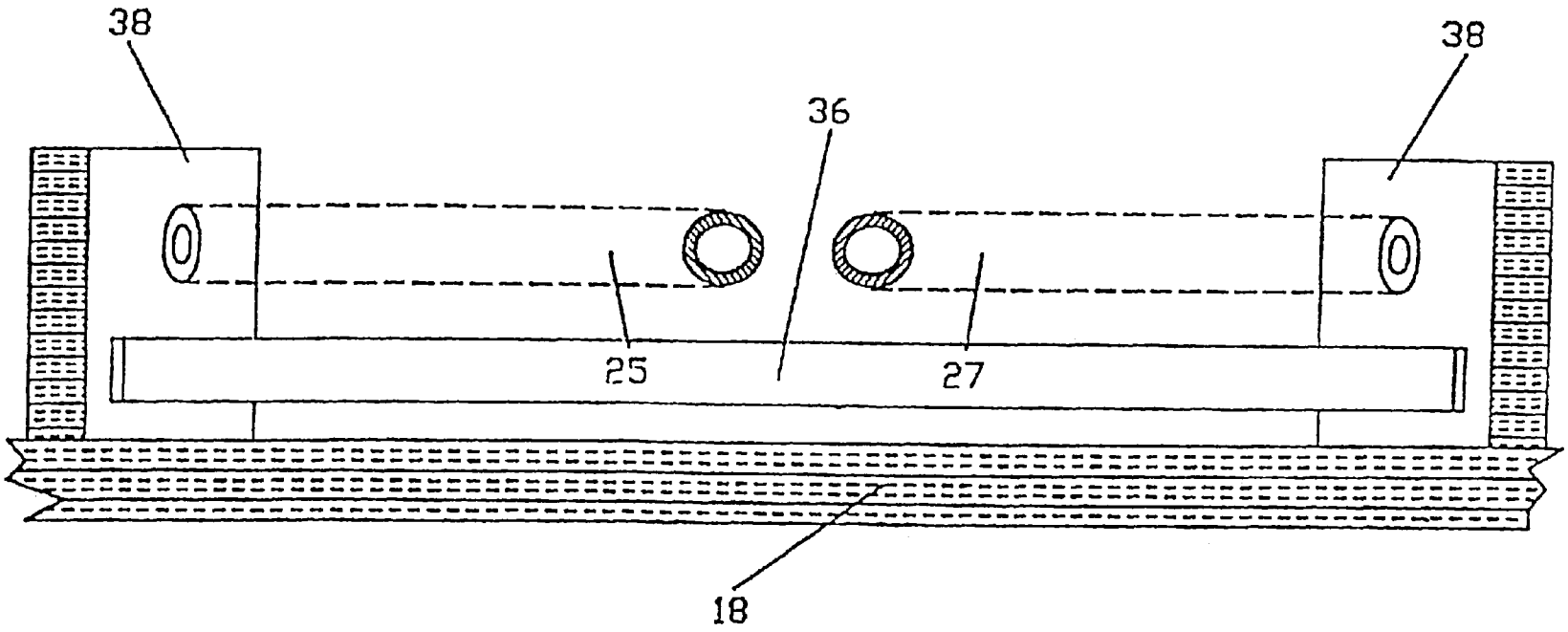
FIG. 4 is a cross-sectional view taken along Line 4—4 of FIG. 3.

Shown in FIG. 7 is segment EF of the connecting and mounting assembly 38 which, specifically, shows a connection of cable 16, and its terminal 55, to ends 23 of leg 24 of loop 25 of radial loop pair 29. Thereby, end 23 of loop pair 25 is connected to feedline cable 16 and, as well, to conductor 36 which, as is also shown in the views of FIGS. 3 and 4, will connect the loop pair 25 in the left of FIG. 3 to the loop pair in the right of FIG. 3 by the connection of loop end E to loop end F.

As may be further noted in FIG. 7, a simple combination of hex bolts 45 and lock nuts 46 may be employed to effect the securement of insulator 38 to center region 18 and, similarly, a nut 44 may be easily threaded through hole 51 of insulator 38, hole 53 of conductor 36 (see FIG. 3) terminal 55 of feedline cable 17 and, therefrom, into end 23 of loop leg 24 to thereby create a secure electrical conduction between said elements and, thereby, provides the electrical connection necessary to form the above defined system.

Figure 8:
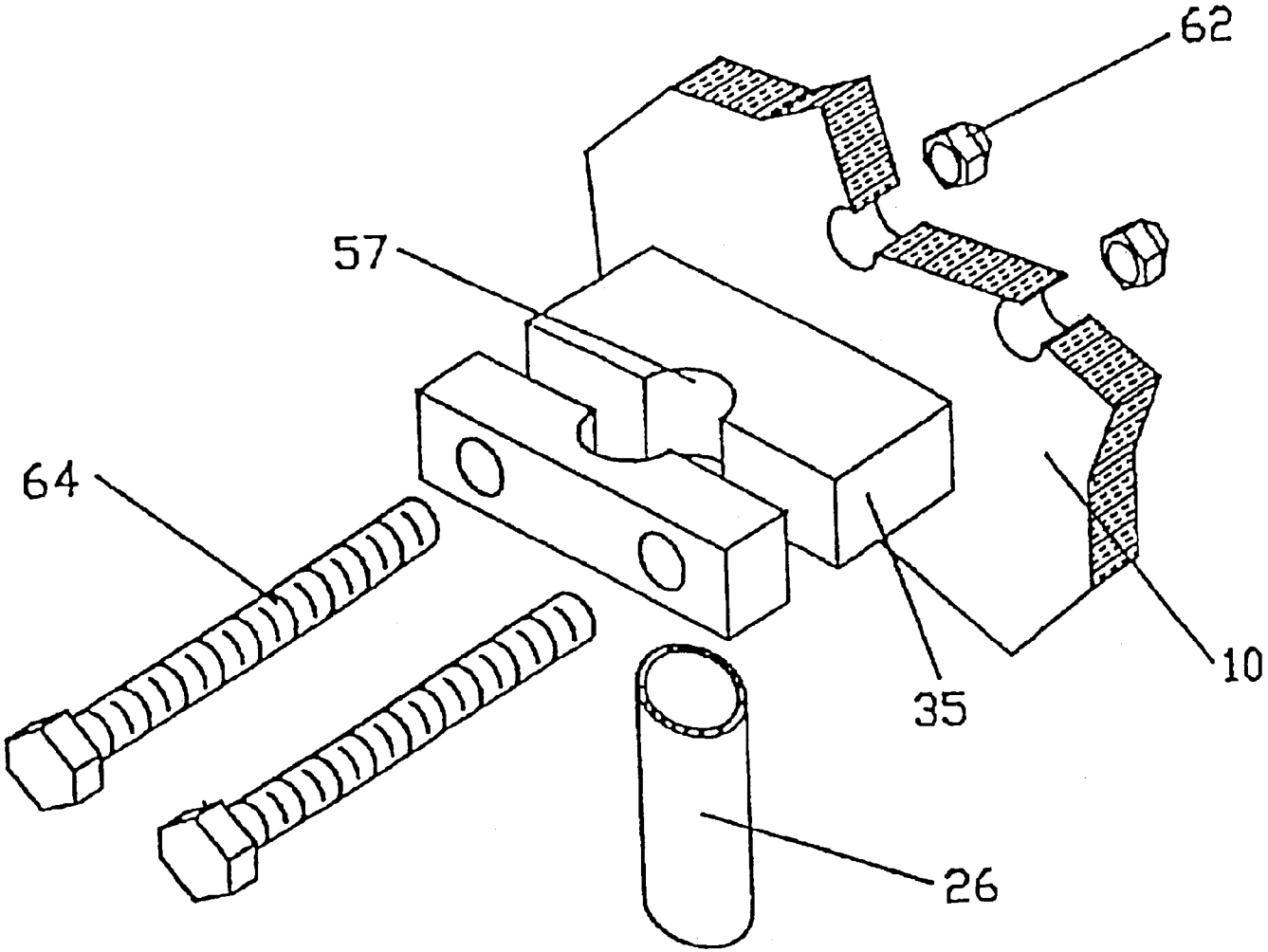
FIG. 8 is an exploded view of the outermost insulator assembly.

With reference to the view of FIG. 8, there is shown, in exploded view, the hardware associated with outer mounting and insulation means 35 (see also FIG. 2). In FIG. 8, it is noted that through the use of wing nut 62 and hexbolts 64, leg 26 of loop pair 25 may be readily secured within opening 57 of mounting element 35.

As above noted, it has been found that the inventive antenna system does not require a curved or parabolic reflector but, rather, will function satisfactorily with the use of a substantially flat reflector. Accordingly, a substantial saving, from a production and cost point of view, is effectuated in the dispensation of a parabolic reflector. Additionally, it has been found that loop pairs 29 may be formed of a metallic tubing such as aluminum and that, in one embodiment, a 0.375 gauge aluminum tubing having an internal diameter of 0.325 inches has been found suitable. The tubing is shown in cross-section in the view of FIG. 8.

Figure 6:
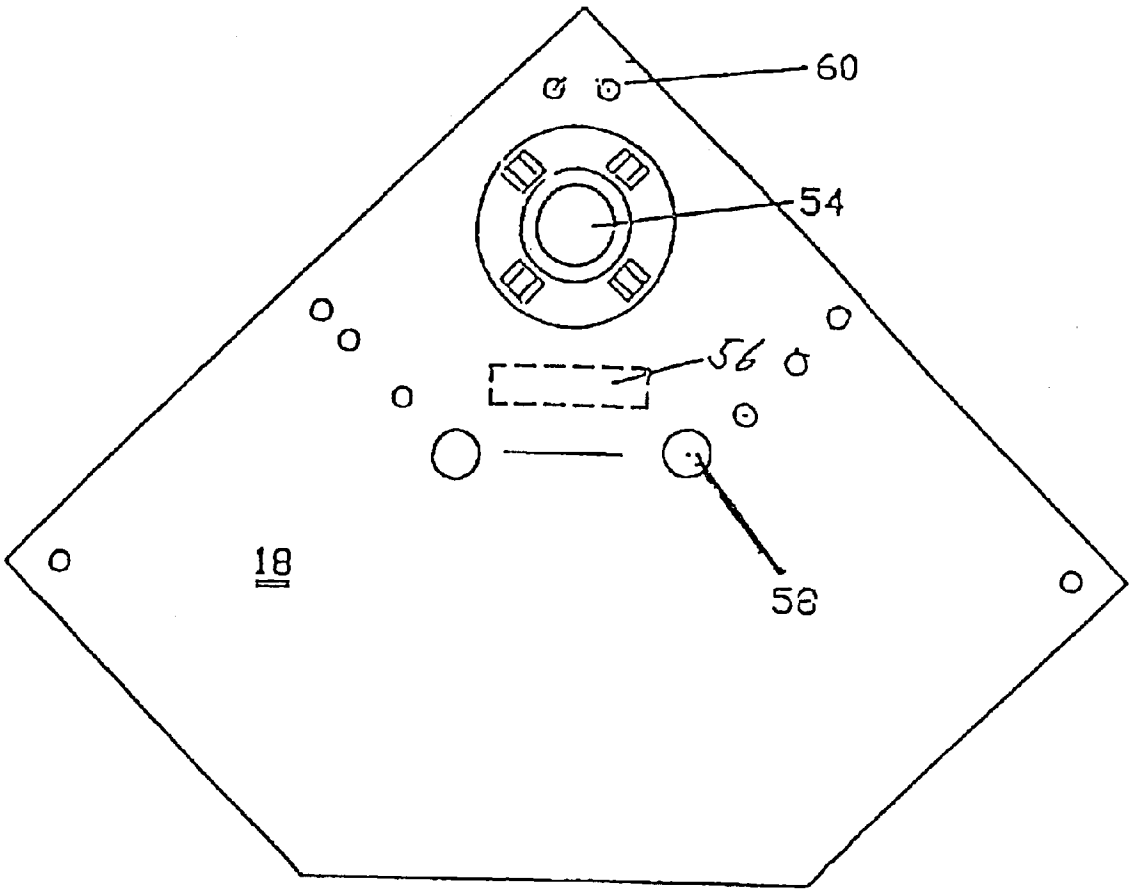
FIG. 6 is a plan view of the back center portion of the antenna.

With reference to FIG. 6, there is shown a rear view of the center region 18 and, therein, may be seen holes 58 through which the feedline transmission cable reach ends 23 of the loop pairs 29. Also shown therein is recess 54 within which upper post element 12 is secured. Further shown are insulator support holes 60 into which bolts supporting insulation means 33 may pass.

It may therefore be appreciated that the within invention improves inter alia over that of my U.S. Pat. No. 4,989,014 in its change of the shape of the reflector and its elimination of any use of circumferential edges.

Accordingly, while there has been shown and described a preferred embodiment of the present invention, it will be understood that the invention may be embodied otherwise than is herein specifically illustrated and described and that, within said embodiment, certain changes in the detain and construction, in the form and arrangement of the parts, may be made without departing from the underlying ideas or principles of this invention within the scope of the appended Claims.

What is claimed is:

1. An antenna system for electrical connection to positive and negative sides of a transmission reception, said system comprising:

(a) a reflector defined by respective orthogonal ear-like portions of reflector including a substantially triangular lower region;

(b) at least two electrically conductive open-ended radial logo pairs, having positive and negative ends, of hollow substantially scalene triangular loops, each loop of each pair being internally symmetric about a radius of said reflector, and said loop pairs uniformly offset from said reflector by insulative mounting means; and (c) upon said reflector, means for electrically connecting one negative end of one of said open ended loop pairs to an adjacent negative end of another of said loop pairs to thereby define at least two loop pairs, each of said two loop pairs comprising a single conductive array which is electronically, but not radiationally, discreet from said reflector, and in which one loop end of each loop pair is connected to a corresponding positive and negative side respectively of said transmission feedline, whereby the electromagnetic geometry of said conductive loop pairs of said conductive surface will co-act to amplify signals received from said reflector to provide an effective antenna reception.

2. The antenna system as recited in claim 1, in which said reflector comprises a substantially flat surface.

3. The antenna system as recited in claim 1, in which the legs of each of said scalene triangular loops define a ratio of one-to-two-to-three as between the smallest, intermediate, and hypotenuse legs thereof.

4. The antenna system as recited in claim 3, in which said loops of said loop pairs comprise aluminum tubing.

5. The system as recited in claim 3, in which said system further comprises:

reflector mounting means for selectively changing the angulation of a plane of said reflector relative to a supporting plane of reference thereof.

6. The system as recited in claim 1, in which said reflector comprises a parabolic surface.

7. The reception antenna system as recited in claim 1, in which said reflector comprises a substantially flat surface.

8. The system as recited in claim 7, in which said system comprises:

reflector mounting means for selectively changing the angulation of a plane of said reflector relative to a supporting plane of reference thereof.

9. The system as recited in claim 2, in which said reflector includes a covering of mesh coating of conductive fibers.

10. The system as recited in claim 3, in which said reflector includes a covering of mesh coating of conductive fibers.

11. The system as recited in claim 6, in which said reflector includes a covering of mesh coating of conductive fibers.

* * * * *